US005186233A

United States Patent [19]

Obata et al.

[11] Patent Number: 5,186,233

[45] Date of Patent: Feb. 16, 1993

[54] METHOD OF PRODUCING SPHEROIDAL GRAPHITE CAST IRON ARTICLE

[75] Inventors: Fumio Obata; Toshiaki Tanaka; Hideaki Nagayoshi, all of Kitakyusyu, Japan

[73] Assignee: Hitachi Metals, Ltd., Tokyo, Japan

[21] Appl. No.: 862,230

[22] Filed: Apr. 2, 1992

[30] Foreign Application Priority Data

Apr. 4, 1991 [JP] Japan ..... 3-71426

[51] Int. Cl.[5] ..... B22D 27/00

[52] U.S. Cl. ..... 164/58.1; 164/55.1

[58] Field of Search ..... 164/58.1, 57.1, 56.1, 164/55.1

[56] References Cited

U.S. PATENT DOCUMENTS

| | | | |
|---|---|---|---|
| 3,905,809 | 9/1975 | Malizio et al. | 420/25 |
| 4,004,630 | 1/1977 | Dunks | 164/57.1 |
| 4,245,691 | 1/1981 | Mohla | 164/56.1 |
| 4,414,027 | 11/1983 | Gorgerino et al. | 420/578 |
| 4,450,019 | 5/1984 | Satou et al. | 420/25 |
| 4,779,663 | 10/1988 | Pruyne et al. | 164/58.1 |

*Primary Examiner*—Richard K. Seidel
*Assistant Examiner*—Erik R. Puknys
*Attorney, Agent, or Firm*—Finnegan, Henderson, Farabow, Garrett & Dunner

[57] ABSTRACT

A spheroidal graphite cast iron article having a thin portion and a thick portion, the number of spheroidal graphite particles having a diameter of 2 μm or more being 600 /mm$^2$ or more and less than 2000 /mm$^2$ in the thin portion and 130 /mm$^2$ or more and less than 600 /mm$^2$ in the thick portion, and spheroidization percentage being 70% or more in the thick portion, is produced by a method comprising the steps of: (a) preparing an iron-base alloy melt having a composition consisting essentially by weight of 3.0–4.0% of C, 0.8–1.7% of Si, 1.0% or less of Mn, 0.2% or less of P, 0.01–0.2% of S, the balance being substantially Fe and inevitable impurities; (b) desulfurizing the iron-base alloy melt to control the sulfur content of the melt to less that 0.01% by weight; (c) adding a sulfur-containing material to the melt in such an amount that the sulfur content of the melt becomes 0.011–0.03% by weight; and (d) adding an Mg-containing material and a lanthanide element to the melt to conduct a spheroidizing treatment.

8 Claims, 3 Drawing Sheets

METHOD OF PRODUCING SPHEROIDAL GRAPHITE CAST IRON ARTICLE

BACKGROUND OF THE INVENTION

The present invention relates to a method of producing a spheroidal graphite cast iron article suffering from little volume shrinkage.

Since spheroidal graphite cast iron has excellent mechanical strength, it is widely used in various applications including automobile parts, machine parts, etc. Also, because of recent trend of increasing fuel efficiency of automobiles, it is proposed to make cast iron products thinner. However, since the cast iron products as automobile parts are composed of thin portions and thick portions in many cases, it is highly likely that when cast by a conventional method, shrinkage cavities are generated in the cast products. To prevent the generation of shrinkage cavities, a large riser may be used. However, a large riser leads to a higher production cost of spheroidal graphite cast iron articles. In addition, there is a problem that chill is likely to appear in a thin portion of the spheroidal graphite cast iron article, resulting in poor mechanical strength.

To prevent the generation of shrinkage cavities in a thick portion, it is necessary to suppress the volume shrinkage of the spheroidal graphite cast iron article in the process of solidification from the melt. The shrinkage cavities can be suppressed by inoculating a material which forms nuclei for the precipitation of graphite. In this case, graphitization is accelerated by the inoculation of the above material, and the resulting graphite serves to expand the volume of the spheroidal graphite cast iron article. This is the mechanism of preventing the generation of shrinkage cavities.

Also, when the precipitation of graphite is accelerated in a thin portion, the generation of chill is prevented, resulting in higher mechanical strength.

Conventionally used as a material of forming nuclei for the precipitation of graphite is a combination of a lanthanide element and sulfur. However, sulfur in a molten state in the melt of a spheroidal graphite cast iron fails to generate a sufficient amount of nuclei. Accordingly, the addition of a lanthanide element and sulfur cannot provide a spheroidal graphite cast iron article with improved mechanical strength.

OBJECT AND SUMMARY OF THE INVENTION

Accordingly, an object of the present invention is to provide a method of producing a spheroidal graphite cast iron article free from shrinkage cavities even in a thin portion thereof.

As a result of intense research in view of the above object, the inventors have found that by adding a sulfur-containing material and then a combination of an Mg-containing material and a lanthanide element, a high spheroidization percentage can be achieved so that the resulting spheroidal graphite cast iron article can have improved mechanical strength due to little or no shrinkage cavities. Incidentally, if the sulfur content of the iron-base alloy melt is too high, it should be reduced to less than a proper level before adding the sulfur-containing material. This is because if the sulfur content exceeds the proper level by adding the sulfur-containing material, the spheroidization of graphite is hindered.

Thus, the first method of producing a spheroidal graphite cast iron article having a thin portion having a thickness of 2 mm or more and less than 10 mm and a thick portion having a thickness of 10 mm or more and less than 100 mm, the number of spheroidal graphite particles having a diameter of 2 μm or more being 600/mm$^2$ or more and less than 2000/mm$^2$ in said thin portion and 130/mm$^2$ or more and less than 600/mm$^2$ in said thick portion, and spheroidization percentage being 70% or more in said thick portion, comprising the steps of:

(a) preparing an iron-base alloy melt having a composition consisting essentially by weight of 3.0–4.0% of C, 0.8–1.7% of Si, 1.0% or less of Mn, 0.2% or less of P, 0.01–0.2% of S, the balance being substantially Fe and inevitable impurities;

(b) desulfurizing said iron-base alloy melt to control the sulfur content of said melt to less than 0.01% by weight;

(c) adding a sulfur-containing material to said melt in such an amount that the sulfur content of said melt becomes 0.011–0.03% by weight; and (d) adding an Mg-containing material and a lanthanide element to said melt to conduct a spheroidizing treatment.

The second method of producing a spheroidal graphite cast iron article having a thin portion having a thickness of 2 mm or more and less than 10 mm and a thick portion having a thickness of 10 mm or more and less than 100 mm, the number of spheroidal graphite particles having a diameter of 2 μm or more being 600/mm$^2$ or more and less than 2000/mm$^2$ in said thin portion and 130/mm$^2$ or more and less than 600/mm$^2$ in said thick portion, and spheroidization percentage being 70% or more in said thick portion, comprising the steps of:

(a) preparing an iron-base alloy melt having a composition consisting essentially by weight of 3.0–4.0% of C, 0.8–1.7% of Si, 1.0% or less of Mn, 0.2% or less of P, less than 0.01% of S, the balance being substantially Fe and inevitable impurities;

(b) adding a sulfur-containing material to said melt in such an amount that the sulfur content of said melt becomes 0.011–0.03% by weight; and (c) adding an Mg-containing material and a lanthanide element to said melt to conduct a spheroidizing treatment.

DETAILED DESCRIPTION OF THE INVENTION

Figure 1:
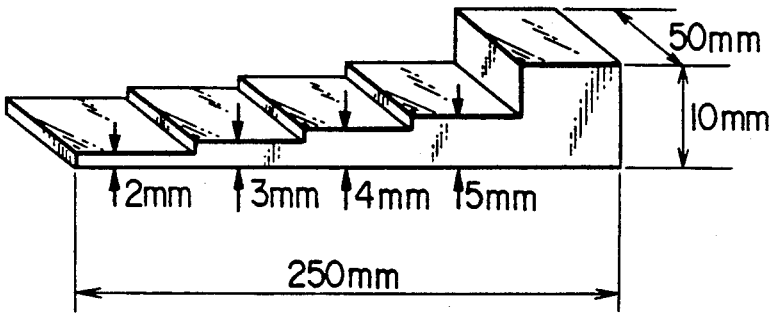
FIG. 1 is a perspective view showing a test piece having a stepwise cross section.

[A] Composition of Spheroidal Graphite Cast Iron Melt (1) C: 3.0–4.0% by weight

Carbon has a function of forming carbides and graphite particles. When the amount of C is smaller than 3.0% by weight, there are casting cavities and chills. On the other hand, when the amount of C exceeds 4.0% by weight, Kish graphite is precipitated. Accordingly, the amount of C is 3.0–4.0% by weight.

(2) Si: 0.8–1.7% by weight

When the amount of Si is smaller than 0.8% by weight, chills are generated. On the other hand, when the amount of Si exceeds 1.7% by weight, the resulting cast iron shows poor toughness at a low temperature. Accordingly, the amount of Si is 0.8–1.7% by weight.

(3) Mn: 1.0% by weight or less

When the amount of Mn exceeds 1.0% by weight, the resulting cast iron shows too high hardness, resulting in poor workability. Accordingly, the amount of Mn is 1.0% or less.

(4) P: 0.2% by weight or less

Phosphorus deteriorates the mechanical strength of the spheroidal graphite cast iron. Accordingly, the amount of P is 0.2% by weight or less. More preferably, the amount of P is 0.05% by weight or less.

(5) S: 0.2% by weight or less

Since a sulfur-containing material is added in the inoculation step, sulfur should be 0.2% by weight or less in the starting melt. If the amount of S is larger than 0.2% by weight, the sulfur content of the spheroidal graphite cast iron melt after the addition of the sulfur-containing material exceeds a permissible level, even if desulfurization is conducted.

More specifically, if the first method of the present invention is used, namely, if the desulfurization of the melt is conducted before adding the sulfur-containing material, the sulfur content may be 0.01–0.2% by weight. On the other hand, if the second method is used, namely, if the desulfurization of the melt is not conducted before adding the sulfur-containing material, the sulfur content of the starting melt should be less than 0.01% by weight.

[B] The First Production Method of Spheroidal Graphite Cast Iron Article (1) Desulfurization Since the sulfur content of the iron-base alloy melt is 0.01% by weight or more, the melt should be desulfurized to a sulfur content level of less than 0.01% by weight before adding the sulfur-containing material. If the sulfur content is larger than 0.01% by weight before adding the sulfur-containing material, the resulting spheroidal graphite cast iron article would suffer from shrinkage cavities and so poor mechanical strength.

Desulfurization of the melt is conducted by adding calcium carbide ($CaC_2$). The sulfur content of the desulfurized iron-base alloy melt should be less than 0.01% by weight.

(2) Addition of sulfur-containing material

The sulfur-containing materials usable in the present invention include iron sulfide (FeS), MnS, etc.

The sulfur-containing material is added to the melt in a shaking ladle, or by using a stirrer, or injected into the melt at a temperature of 1350° C.–1450° C. By this treatment, the sulfur content of the melt becomes 0.011–0.03% by weight. If the sulfur content of the iron-base alloy melt is lower than 0.011 wt. %, the generation of the nuclei for graphite particles is insufficient, resulting in insufficient volume expansion. Further, the number of graphite particles decreases, and a cementite phase is formed, leading to poor mechanical strength and poor machinability. On the other hand, if the sulfur content of the iron-base alloy melt is higher than 0.03 wt. %, the spheroidization of the cast iron becomes insufficient.

(2) Addition of Mg-containing material and lanthanide element

The Mg-containing materials usable in the present invention include $Fe_{bal}$-$Si_{45}$-$Mg_6$-$Re_{2.5}$-$Ca_{3.5}$, etc. The lanthanide elements usable in the present invention include La, Ce, Nd, Pr, etc., and their mixtures such as $La_{35\%}$-$Ce_{50\%}$-$(Nd, Pr)_{15\%}$, etc. The lanthanide elements may be contained in the Mg-containing material. Such composite compounds are ferrosilicon magnesium rare earth, $Fe_{bal}$-$Si_{45}$-$Mg_6$-$Re_{2.5}$-$Ca_{3.5}$, etc.

The amount of the Mg-containing material added to the melt is preferably 0.06–0.08% by weight as an Mg equivalent, and the amount of the lanthanide element is preferably 0.03–0.04 wt. % by weight. If the amount of the Mg-containing material is smaller than 0.06 wt. %, sufficient spheroidization cannot be achieved. On the other hand, if the amount of the Mg-containing material is larger than 0.08 wt. %, excess Mg reacts with a sulfur component which is necessary for the formation of spheroidal graphite particles, resulting in a low spheroidization percentage. Also, if the amount of the lanthanide element is smaller than 0.03 wt. %, the formation of the nuclei for graphite particles is insufficient. On the other hand, if the amount of the lanthanide element is larger than 0.04 wt. %, the spheroidization of graphite is hindered.

By the addition of the Mg-containing material and the lanthanide element, the iron-base alloy melt is spheroidized so that the resulting spheroidal graphite cast iron has a large number of spheroidal graphite particles in its microstructure. the number of spheroidal graphite particles depends on the thickness of the spheroidal graphite cast iron article. Specifically, in a thin portion of the spheroidal graphite cast iron article, which has a thickness of 2 mm or more and less than 10 mm, the number of spheroidal graphite particles is $600/mm^2$ or more and less than $2000/mm^2$. In a thick portion of the spheroidal graphite cast iron article, which has a thickness of 10 mm or more and less than 100 mm, the number of spheroidal graphite particles is $130/mm^2$ or more and less than $600/mm^2$. Also, in the thick portion, the spheroidization percentage is as high as 70% or more.

The Mg-containing material and the lanthanide element may be placed on the bottom of a ladle, into which the melt is introduced. By utilizing this process, it is easy to control the spheroidization percentage.

Incidentally, before pouring into a mold, an inoculant may be added to the melt. Such inoculant is an Si-containing material such as ferrosilicon, Fe-$Si_{73}$, etc.

[C] The Second Production Method of Spheroidal Graphite Cast Iron Article

The second production method of spheroidal graphite cast iron article is not different from the first method, except that desulfurization is not conducted in the second method. This is because the iron-base alloy melt to be subjected to a spheroidizing treatment has a sulfur content of as low as less than 0.01% by weight.

The reason why the number of the shrinkage cavities is small in the spheroidal graphite cast iron article produced by the method of the present invention is considered as follows: When the Mg-containing material and the lanthanide element are added simultaneously, the lanthanide element becomes a sulfide, which constitutes nuclei for precipitation of graphite. Thus, spheroidization is accelerated, increasing the volume ratio of the spheroidal graphite particles in the resulting spheroidal graphite cast iron. This functions to suppress the shrinkage of the spheroidal graphite cast iron in the process of solidification.

In addition, the Mg-containing material and the lanthanide element function to prevent the generation of chill in the thin portion of the spheroidal graphite cast iron article, thereby improving the mechanical strength of the spheroidal graphite cast iron article.

The present invention will be explained in further detail by way of the following Examples:

EXAMPLE 1

An iron-base alloy melt having a chemical composition shown in Table 1 and inevitable impurities was prepared in an acid high-frequency induction furnace having a volume of 150 kg.

TABLE 1

| Chemical Composition (wt. %) | | | | | |
|---|---|---|---|---|---|
| C | Si | Mn | P | S | Fe |
| 3.71 | 1.25 | 0.21 | 0.025 | 0.030 | bal. |

After heating the melt to 1450° C., 0.5% by weight of carbide was added to the melt to desulfurize it to a sulfur content of 0.006% by weight.

The above starting melt was heated to 1550° C., and iron sulfide was added thereto in an amount of 0.010% by weight as an S equivalent. Next, 1.5% by weight of ferrosilicon magnesium rare earth (by weight, Si: 45%, Mg: 4%, Ca: 1.5%, a mixture of lanthanides (Ce 50%, La 35%, Nd, etc. 15%): 2.0%, Fe: balance) was placed in a ladle, and the melt was introduced into the ladle. As a result, spheroidization took place.

The resulting melt was poured into each sand mold shown in Table 2 and a sand mold for a stepwise test piece shown in FIG. 1 at a temperature of 1410° C. In the process of pouring the melt into the sand mold, an inoculant (Si: 72% by weight, Fe: balance) of 48 mesh or more and less than 100 mesh was added to the stream of the melt.

TABLE 2

| Type of Mold for | Dimension (mm) |
|---|---|
| Y-block Test Piece | 25 × 250 |
| Round Test Piece | $\phi$100 × 200 |
| Porosity Test Piece | 200 × 300 × 45 |

Figure 2:
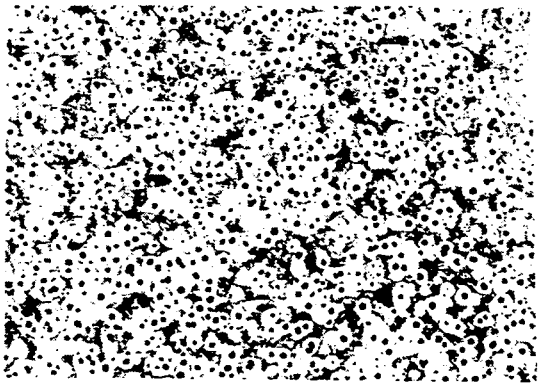
FIG. 2 is a photomicrograph (magnification: ×100) showing the metal microstructure of a test piece made of a spheroidal graphite cast iron according to the present invention (Example 1)
Figure 3:
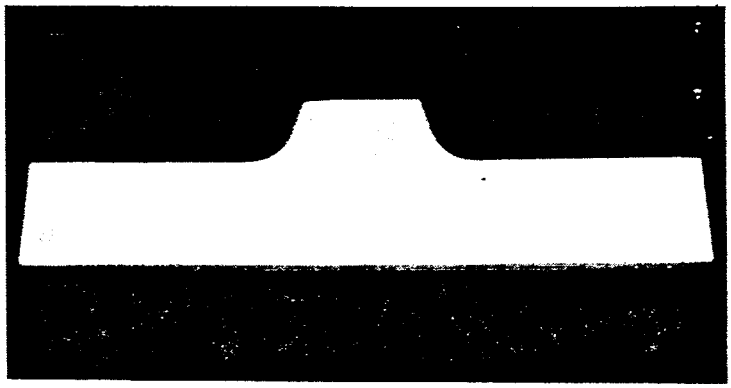
FIG. 3 is a photograph showing the color-checked cross section of the test piece made of the spheroidal graphite cast iron of Example 1.

The Y-block test piece thus prepared was machined in its well-cast portion to obtain a tensile test piece. A photo-micrograph (×100) of a grip portion of the tensile test piece is shown in FIG. 2. With respect to the stepwise test piece and the round test piece, the number of graphite particles (diameter: 2 μm or more) and spheroidization percentage were measured by an image analyzer for each thickness of the test piece. The results are shown in Table 3. Further, a color-checked cross section of the cast porosity test piece is shown in FIG. 3.

TABLE 3

| Thickness (mm) | Number of Graphite Particles* | Spheroidization Percentage (%) | Ferrite Percentage (%) |
|---|---|---|---|
| 2 | 2005 | 87.5 | 68.7 |
| 10 | 627 | 80.2 | 76.2 |
| 100 | 151 | 75.1 | 82.5 |

Note
*per 1 $mm^2$.

COMARTATIVE EXAMPLE 1

An Mg-containing material (by weight, Si: 45%, Mg: 6%, Ca: 1.5%, Fe: balance) was placed in a ladle in an amount of 0.040% by weight as an Mg equivalent, and the same starting melt as in Example 1, which was heated to 1550° C., was introduced into the ladle. As a result, spheroidization took place.

The resulting melt was poured into each sand mold shown in Table 2 and a sand mold for a stepwise test piece shown in FIG. 1 at a temperature of 1430° C. In the process of pouring the melt into the sand mold, an inoculant (Si: 72% by weight, Fe: balance) of 48 mesh or more and less than 100 mesh was added to the stream of the melt.

Figure 4:
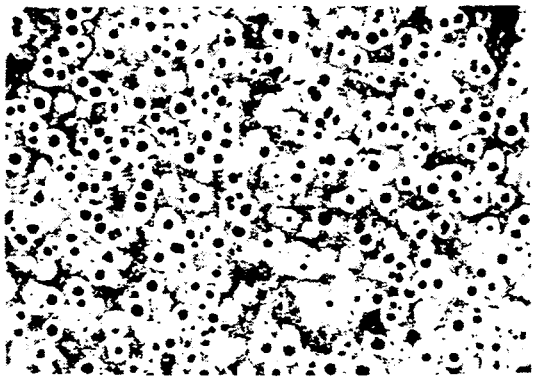
FIG. 4 is a photomicrograph (magnification: ×100) showing the metal microstructure of a test piece made of a conventional spheroidal graphite cast iron.
Figure 5:
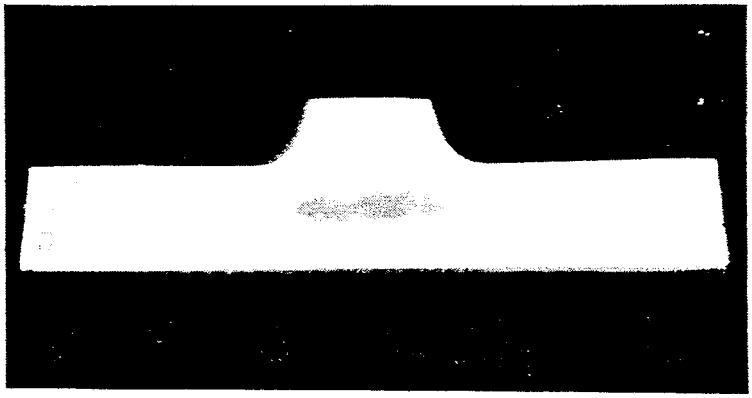
FIG. 5 is a photograph showing the color-checked cross section of the test piece made of the spheroidal graphite cast iron of FIG. 4.

The Y-block test piece thus prepared was machined in its well-cast portion to obtain a tensile test piece. A photo-micrograph (×100) of a grip portion of the tensile test piece is shown in FIG. 4. With respect to the stepwise test piece and the round test piece, the number of graphite particles (diameter: 2 μm or more) and spheroidization percentage were measured by an image analyzer for each thickness of the test piece. The results are shown in Table 4. Further, a color-checked cross section of the cast porosity test piece is shown in FIG. 5.

TABLE 4

| Thickness (mm) | Number of Graphite Particles* | Spheroidization Percentage (%) | Ferrite Percentage (%) |
|---|---|---|---|
| 2 | 982 | 85.4 | 49.6 |
| 10 | 305 | 81.3 | 52.1 |
| 100 | 87 | 79.2 | 56.4 |

Note
*per 1 $mm^2$.

EXAMPLE 2

An iron-base alloy melt having a chemical composition shown in Table 5 and inevitable impurities was prepared in an acid high-frequency induction furnace having a volume of 150 kg.

TABLE 5

| Chemical Composition (wt. %) | | | | | |
|---|---|---|---|---|---|
| C | Si | Mn | P | S | Fe |
| 3.67 | 1.25 | 0.21 | 0.027 | 0.007 | bal. |

After heating the melt to 1530° C., iron sulfide was added thereto in an amount of 0.012% by weight as an S equivalent. Next, 1.5% by weight of ferrosilicon magnesium rare earth (by weight, Si: 45%, Mg: 4%, Ca: 1.5%, lanthanide: 2.0%, Fe: balance) was placed in a ladle, and the melt was introduced into the ladle. As a result, spheroidization took place.

The resulting melt was poured into each sand mold shown in Table 2 and a sand mold for a stepwise test piece shown in FIG. 1 at a temperature of 1400° C. In the process of pouring the melt into the sand mold, an inoculant (Si: 72% by weight, Fe: balance) of 48 mesh or more and less than 100 mesh was added to the stream of the melt.

Figure 6:
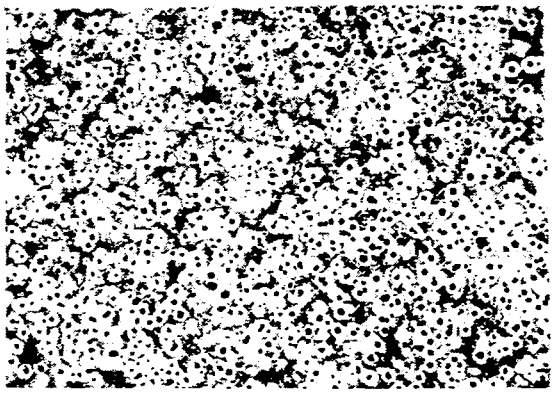
FIG. 6 is a photomicrograph (magnification: ×100) showing the metal microstructure of a test piece made of a spheroidal graphite cast iron according to the present invention (Example 2)
Figure 7:
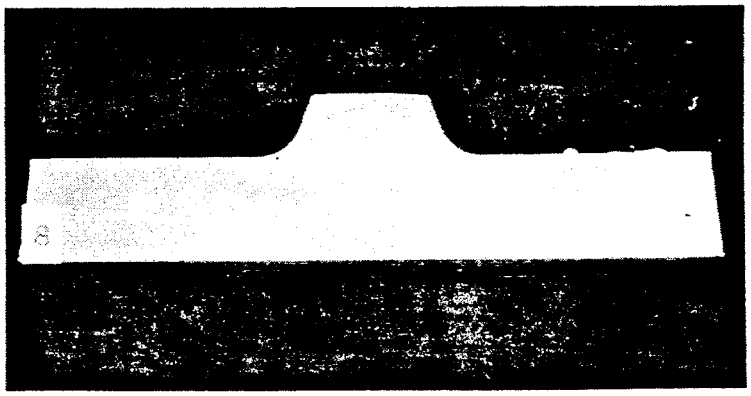
FIG. 7 is a photograph showing the color-checked cross section of the test piece made of the spheroidal graphite cast iron of Example 2.

The Y-block test piece thus prepared was machined in its well-cast portion to obtain a tensile test piece. A photo-micrograph (×100) of a grip portion of the tensile test piece is shown in FIG. 6. With respect to the stepwise test piece and the round test piece, the number of graphite particles (diameter: 2 μm or more) and spheroidization percentage were measured by an image analyzer for each thickness of the test piece. The results are shown in Table 6. Further, a color-checked cross section of the cast porosity test piece is shown in FIG. 7.

TABLE 6

| Thickness (mm) | Number of Graphite Particles | Spheroidization Percentage (%) | Ferrite Percentage (%) |
|---|---|---|---|
| 2 | 1995 | 88.2 | 59.2 |
| 10 | 576 | 81.5 | 75.7 |
| 100 | 147 | 77.2 | 79.5 |

Note
*per 1 $mm^2$.

As described above, by adding an Mg-containing material and a lanthanide element to a spheroidal graphite cast iron melt, which is mixed with a sulfur-containing material if necessary, a sulfide of the lanthanide element is formed and the sulfide constitutes nuclei for the precipitation of graphite particles. By this phenomenon, the volume ratio of graphite particles increases in the process of solidification, accelerating the volume increase of the cast iron. Thus, the generation of shrinkage cavities is prevented. The spheroidal graphite cast iron article produced by the method of the present invention does not suffer from shrinkage cavities and chill.

What is claimed is:

1. A method of producing a spheroidal graphite cast iron article having a thin portion having a thickness of 2 mm or more and less than 10 mm and a thick portion having a thickness of 10 mm or more and less than 100 mm, the number of spheroidal graphite particles having a diameter of 2 μm or more being 600/$mm^2$ or more and less than 2000/$mm^2$ in said thin portion and 130/$mm^2$ or more and less than 600/$mm^2$ in said thick portion, and spheroidization percentage being 70% or more in said thick portion, comprising the steps of:

(a) preparing an iron-base alloy melt having a composition consisting essentially by weight of 3.0–4.0% of C, 0.8–1.7% of Si, 1.0% or less of Mn, 0.2% or less of P, 0.01–0.2% of S, the balance being substantially Fe and inevitable impurities;

(b) desulfurizing said iron-base alloy melt to control the sulfur content of said melt to less than 0.01% by weight;

(c) adding a sulfur-containing material to said melt in such an amount that the sulfur content of said melt becomes 0.011–0.03% by weight; and (d) adding an Mg-containing material and a lanthanide element to said melt to conduct a spheroidizing treatment.

2. A method of producing a spheroidal graphite cast iron article having a thin portion having a thickness of 2 mm or more and less than 10 mm and a thick portion having a thickness of 10 mm or more and less than 100 mm, the number of spheroidal graphite particles having a diameter of 2 μm or more being 600/$mm^2$ or more and less than 2000/$mm^2$ in said thin portion and 130/$mm^2$ or more and less than 600/$mm^2$ in said thick portion, and spheroidization percentage being 70% or more in said thick portion, comprising the steps of:

(a) preparing an iron-base alloy melt having a composition consisting essentially by weight of 3.0–4.0% of C, 0.8–1.7% of Si, 1.0% or less of Mn, 0.2% or less of P, less than 0.01% of S, the balance being substantially Fe and inevitable impurities;

(b) adding a sulfur-containing material to said melt in such an amount that the sulfur content of said melt becomes 0.011–0.03% by weight; and (c) adding an Mg-containing material and a lanthanide element to said melt to conduct a spheroidizing treatment.

3. The method of producing a spheroidal graphite cast iron article according to claim 1, wherein said Mg-containing material added is in an amount of 0.06–0.08% by weight as an Mg equivalent, and said lanthanide element added is in an amount of 0.03–0.04% by weight as a lanthanide element equivalent.

4. The method of producing a spheroidal graphite cast iron article according to claim 2, wherein said Mg-containing material added is in an amount of 0.06–0.08% by weight as an Mg equivalent, and said lanthanide element added is in an amount of 0.03–0.04% by weight as a lanthanide element equivalent.

5. The method of producing a spheroidal graphite cast iron article according to claim 1, wherein said spheroidizing treatment is conducted in a ladle.

6. The method of producing a spheroidal graphite cast iron article according to claim 2, wherein said spheroidizing treatment is conducted in a ladle.

7. The method of producing a spheroidal graphite cast iron article according to claim 3, wherein said spheroidizing treatment is conducted in a ladle.

8. The method of producing a spheroidal graphite cast iron article according to claim 4, wherein said spheroidizing treatment is conducted in a ladle.

* * * * *